United States Patent [19]

Lehoczky et al.

[11] 4,125,016

[45] Nov. 14, 1978

[54] BATTERY OPERATED TORQUE WRENCH WITH DIGITAL DISPLAY

[75] Inventors: Kenneth A. Lehoczky, Livonia, Mich.; Robert B. Edwards, South Bend, Ind.

[73] Assignee: GSE, Inc., Farmington Hills, Mich.

[21] Appl. No.: 702,670

[22] Filed: Jul. 6, 1976

[51] Int. Cl.[2] ..... B25B 23/14

[52] U.S. Cl. ..... 73/139

[58] Field of Search ..... 73/136 A, 139; 81/52.5

[56] References Cited

U.S. PATENT DOCUMENTS

| | | | |
|---|---|---|---|
| 2,242,613 | 5/1941 | Mandl | 73/139 |
| 3,472,102 | 10/1969 | Dunlap et al. | 73/139 X |
| 3,523,471 | 8/1970 | Lance | 81/52.5 |
| 3,710,874 | 1/1973 | Seccombe et al. | 73/139 X |
| 3,970,155 | 7/1976 | Otto | 73/139 |

FOREIGN PATENT DOCUMENTS

| | | | |
|---|---|---|---|
| 818,276 | 8/1959 | United Kingdom | 73/139 |

*Primary Examiner*—Charles A. Ruehl
*Attorney, Agent, or Firm*—Krass & Young

[57] ABSTRACT

A battery operated torque wrench having a digital display to give a numerical representation of torque applied to a rotational workpiece, such as a socket head bolt. Applied torque is sensed by variable resistors responsive to mechanical strain in a flexure element in the head of the wrench. The variable resistors are connected in a bridge circuit which yields an electrical analog signal when the bridge is unbalanced due to mechanical strain in the variable resistors. The electrical analog signal is tracked and converted into a digital equivalent by a servo-type feedback circuit. Each iteration of the feedback circuit generates a counting pulse which is registered on a set of binary coded decimal (BCD) counters connected in cascade. The outputs of the BCD counters are displayed on light emitting diode displays on the wrench handle. Overrange, underrange, and low power indicator means and power strobing means are also disclosed.

15 Claims, 11 Drawing Figures

BATTERY PACK

Fig-3
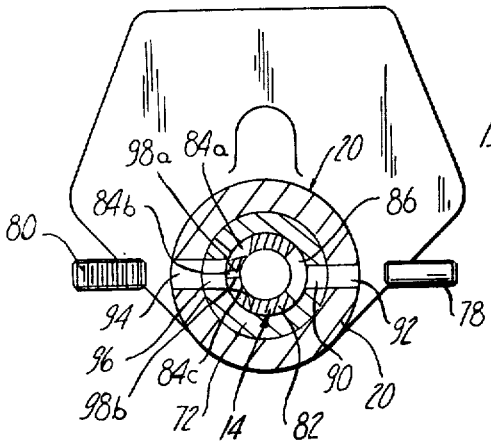
Fig-6
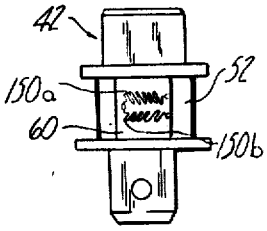
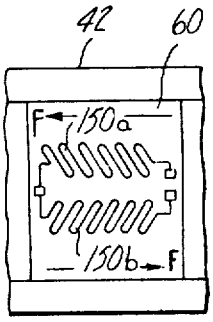
Fig-7
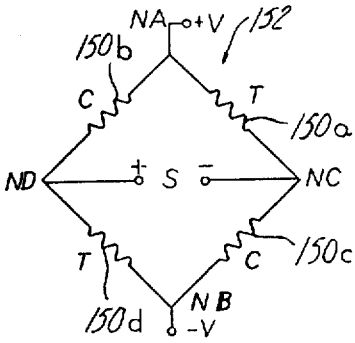
Fig-8
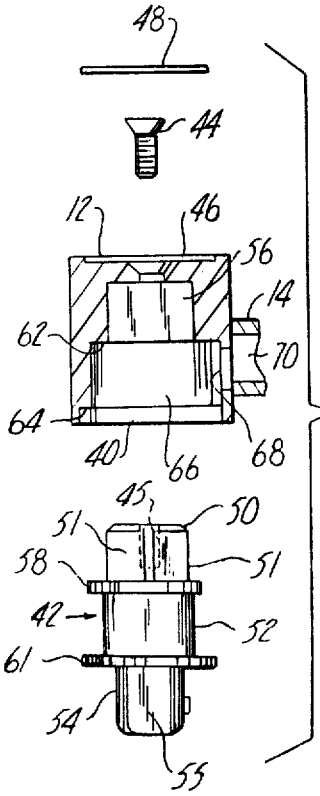
Fig-5
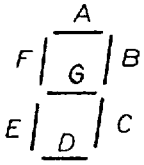
Fig-11

BATTERY OPERATED TORQUE WRENCH WITH DIGITAL DISPLAY

INTRODUCTION

This invention relates to torque wrenches and particularly to a self-contained, electronic torque wrench having a digital display.

BACKGROUND OF THE INVENTION

A well known mechanical device for measuring torque applied to a fastener comprises a scale mounted on the shaft of a torque wrench to indicate the angular deflection of the shaft. The very limited accuracy of this mechanical device makes it unsuitable for applications requiring great precision and care in applying torque.

Increased accuracy may be achieved by electronic means for sensing and displaying applied torque. One such device is disclosed in the U.S. Pat. No. 3,895,517 to Otto. The Otto device includes strain-sensitive variable resistors mounted on the neck of an elongated torque wrench handle to measure bending strain in the handle as torque is applied. The resistors are connected into a bridge. The unbalance signal therefrom is digitized using a clock circuit, decoded and displayed. The clock, decoders and display circuitry are all carried within the handle of the Otto device, although the disclosure of the specific mounting structure is very vague.

BRIEF SUMMARY OF THE INVENTION

The present invention provides an electronic, self-contained torque wrench of improved design. In general the improvements include the removal of the strain sensing elements from the wrench handle to a flexure element which directly contacts the fastener as torque is applied, the elimination of the clock circuit and the substitution of a novel and accurate servotype digitizing circuit having great flexibility of operation, and the definition of a mounting structure for display and associated circuit which is attractive, functional and easily manufactured and assembled. In this preferred embodiment hereinafter described, the applied torque is measured by a flexure insert which is carried in a socket structure on the end of the wrench handle such that torque is applied to the fastener or other workpiece directly through the flexure insert. The insert body is instrumented with strain-sensitive foil-type resistors, commonly called "strain gages", to produce an analog signal representing applied torque. This signal is converted to digital form by an iterative process which involves repeatedly comparing the analog signal to the analog-equivalent of a stored count, generating a difference or "error" signal, and incrementing or decrementing the stored count, until the difference signal is reduced to zero. Clock circuitry is eliminated by signal-responsive switches which drive the error signal to a forced zero condition whenever a non-zero error appears, thus creating a signal transition which increments the stored count.

Since the forced zero terminates the error, the switches again open to sense the non-zero error, which becomes increasingly smaller as the iterations continue. Circuit sensitivity is defined by a voltage window which is set by a pair of comparator amplifier, one for positive error response and one for negative error response.

The display circuitry is operable in various modes including tracking and peak-storing modes. Various power-conserving features are also provided.

For a full appreciation of the invention, reference should be taken to the following detailed description of an illustrative embodiment.

BRIEF DESCRIPTION OF THE DRAWINGS

FIG. 3 is a first cross-sectional view of the handle of the torque wrench taken along line 3—3 of FIG. 1;

FIG. 5 is an enlarged representation of the wrench head components shown in FIG. 2;

FIG. 6 is a side elevational view of the flexure element shown in FIG. 5, illustrating the mounting of strain gages to one of two diametrically opposed flat shear surfaces on the flexure element;

FIG. 7 is an enlarged representation of the flat shear surface shown in FIG. 6, illustrating the orientation of the strain gages;

FIG. 8 is a schematic diagram of a resistive bridge network formed by the electrical connection of strain gages affixed to the flexure element;

DETAILED DESCRIPTION OF THE SPECIFIC EMBODIMENT

Figures 1, 2, 4:
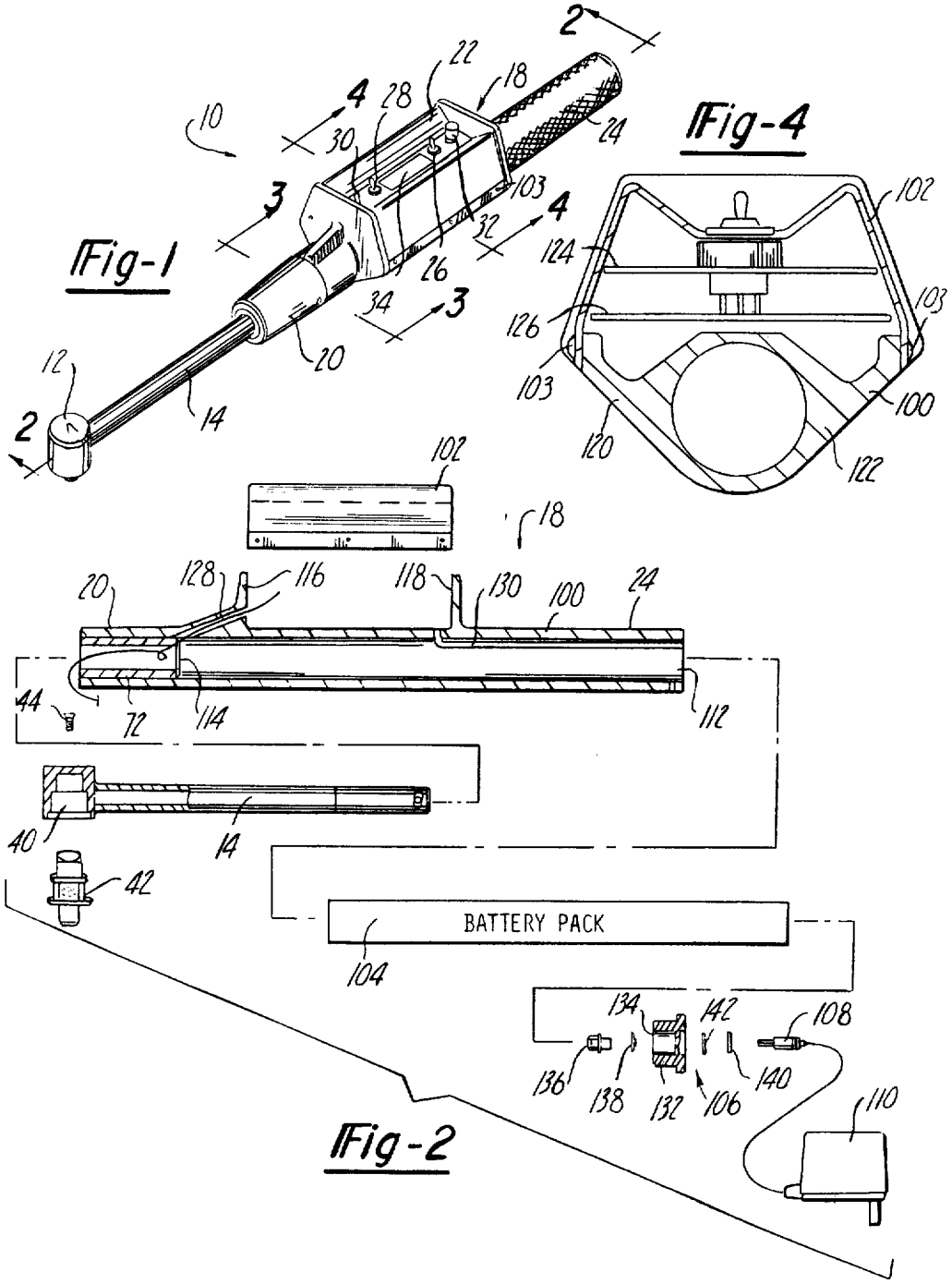
FIG. 1 is a perspective view of a torque wrench embodying the present invention.
FIG. 2 is an exploded elevational view, partially in section, of the torque wrench of FIG. 1, illustrating its constituent parts.
FIG. 4 is a second cross-sectional view of the handle of the torque wrench taken along line 4—4 of FIG. 1.

With reference to FIG. 1, a torque wrench embodying the present invention is shown generally at 10. The wrench 10 has a cylindrical head 12 adapted to engage means for turning a workpiece, such as a threaded fastener or the like. A shaft 14 extends laterally from the cylindrical head 12 and is connected thereto by welding. The shaft 14 connects to an assembly 18 having open cylindrical portion 20 to receive the shaft 14 within a sleeve 72. The assembly 18 further includes a display section 22 and a knurled gripping section 24. The display section has on its upper face an on-off switch 26, a bidirectional switch 28, a track-peak-calibration switch 30, a reset button 32, and a numerical display face 34; all of whose functions will be hereinafter more fully described.

In board outline, the wrench 10 operates as follows. When torque is applied to a workpiece, it produces elastic deformation in the wrench structure. This deformation is sensed by strain gages and translated into a corresponding analog signal. The analog signal is converted to a digital equivalent by an iterative, closed-loop digitizing circuit. In each pass of the loop, the analog signal is compared with an analog feedback signal which represents the current count on a digital counter. This comparison generates a difference signal which is input into a comparator that checks the magnitude and polarity of the difference signal to determine if the current count on the digital counter is high or low. If the magnitude of the difference signal exceeds a tolerance potential, which represents the sensitivity of the device, a switch is enabled to transitorily force the difference signal to zero. The transition in the difference signal causes the digital counter to adjust its current count by one unit, in accordance with the polarity of the error signal. The circuitry suited for implementation of this design is hereinafter described in greater detail.

The torque wrench 10 depicted in FIG. 1 is shown exploded into its constituent mechanical parts in FIG. 2.

The cylindrical head 12 has formed within it a cavity 40 of specific configuration that receives a flexure element 42. An enlarged representation of the relationship between flexure element 42 and cylindrical head 12 is shown in FIG. 5. The flexure element 42 is secured in the head 12 by a screw 44 which engages a tapped bore 45. To provide a discrete appearance, the top of the cylindrical head 12 may be formed with a recessed surface 46 which receives a cover plate 48 to conceal the fastener 44.

The flexure element 42 provides means to transmit torque from the wrench 10 to a workpiece, and should have a high modulus of elasticity, preferably about 30 $\times 16^6$ p.s.i. In the embodiment illustrated, flexure element 42 has three distinct sections. An upper section 50 has four lateral faces 51 which bear against the inner walls of the upper chamber 56 of the cavity 40. A central section 52 is substantially cylindrical in shape, except for two diametrically opposed flats 60 which are shown in FIG. 6, and provided for a purpose that will be more fully hereinafter described. The lower section 54 of flexure element 42 is in the form of a drive member. In the present embodiment, the lower section 54 is adapted to engage with a conventional wrench socket, however, in an alternative embodiment it could assume the shape of a screwdriver head or the like. The upper section 50 and central section 52 are divided by a bearing plate 58. Similarly, the central section 52 is divided from the lower section 54 by a bearing plate 61. When the flexure element 42 is engaged with the cylindrical head 12, bearing plate 58 abuts surface 62. A central section 66 of the cavity 40 is formed asymetrically to form a passage 68 which communicates with an internal, longitudinal passage 70 of the shaft 14 to allow electrical leads to be introduced into the cylindrical head 12. The purpose of this feature will be hereinafter made more apparent.

With reference again to FIG. 2, the shaft 14 fits into the handle assembly 18 through the open end of cylindrical portion 20. The portion carries a sleeve 72 which is dimensioned to closely receive the terminal portion of the shaft 14 opposite the cylindrical head 12. The electrical leads from the printed circuit boards 124 and 126 are introduced into the shaft 14 through opening 128.

The shaft 14 is rotatable to operate in any of three discrete positions, each separated by 45°, as is illustrated in FIG. 3. The end of the shaft 14 which is within assembly portion 20 is formed to have an aperture 86 of approximately 90°. The sleeve 72 and surrounding assembly portion 20 have apertures 90 and 92, respectively, whose centerlines align with the centerlines of the aperture 86. A dowel pin 78 is insertable through apertures 86, 90 and 92 to secure the shaft 14 against axial displacement within sleeve 72. The dowel pin 78, however, does not inhibit angular displacement of the shaft 14 through the anbular range of the aperture 86. The angular position of the shaft 14 is fixed by a set screw 80 which engages a threaded bore 94 in the assembly portion 20 and a threaded bore 96 in the sleeve 72 to abut any one of three spot faces 84*a*, *b* and *c* that are defined by a pair of teeth 98*a* and 98*b*. As is apparent from the drawing, when set screw 80 is removed, the shaft may be rotated into any one of three operating positions, each separated by 45°. As the shaft 14 is rotated, it is prevented from being pulled from the assembly 18 by the pin 78.

The assembly 18 is basically divided into two sections: a display housing section 22 and a gripping section 24. The assembly 18 comprises a hollow cast aluminum housing 100 which contains battery pack 104, a panel 102 which is mounted on housing 100, and an end assembly, shown generally at 106, which is adapted to receive the plug 108 of a conventional battery charging unit 110. The electrical leads 129 from the battery 104 run along the channel 130 and are introduced into the display housing section 22 through opening 131.

Housing 100 is formed to define integral plates 116 and 118 between which panel 102 fits. Panel 102 is fastened to outwardly projecting portions 120 and 122 of housing 100 by means of screws 103.

The electronic support structure contained within the panel 102 is also illustrated in FIG. 4. The circuit components (not shown) are mounted on a pair of spaced, parallel printed circuit boards 124 and 126.

The end assembly 106 includes a plug 132 dimensioned to be closely received within the end 112 of housing 100 and secured with set screw 113. The plug 132 has a longitudinal bore 134 to receive a jack 136 adapted to engage with plug 132. The jack 136 is secured into position by nut 140 and washers 137 and 142.

In the present device, torque is measured by sensing elastic deformation of the flexure element 42 which is removably mounted in the end of the wrench body, as opposed to prior art devices which attempt to measure flexure in the wrench body itself; see for example the patent to Otto, U.S. Pat. No. 3,895,517, previously mentioned.

FIG. 7 is an enlarged illustration of the flat 60 on flexure element 42 and shows a preferred configuration for one of the two strain gages. The vertical axis in FIG. 7 is the longitudinal axis of the flexure element about which the turning force is developed. The strain gage comprises resistive elements 150*a* and 150*b*, each made up of a plurality of thin conductive strips laid on a backing in a serpentine; i.e., a close, return curve, pattern so as to vary substantially equally and oppositely in resistance as the underlying metal surface flexes. This is best accomplished by arranging the elements 150 on opposite sides of the longitudinal center of the flat 60. The fundamental principles of such gages are well understood and will not be described in detail here.

As torque is applied through the flexure element 42, a shear force pattern F develops across the flat 60 tending to increase the resistance of element 150*a* and to decrease the resistance of element 150*b*. A similar phenomenon occurs on the opposite flat. When the four strain gage elements are connected into a bridge circuit as hereinafter described, an analog signal representing applied torque can be generated.

With reference to FIG. 8, strain gages 150*a* and 150*b* are interconnected with a second pair of strain gages 150*c* and 150*d*, that are affixed to the flat on the flexure element 42 which diametrically opposes flat 60, to form a conventional Wheatstone bridge, generally at 152. By selecting strain gages 150*a*, *b*, *c*, and *d* to have coequal nominal resistances, the bridge 152 is in balance when the gages are in an unstressed condition. However, in accordance with well known bridge theory, when the strain gages 150*a, b, c,* and *d* undergo tension and compression in the manner heretofore discussed, the bridge 152 becomes unbalanced, and by applying a voltage ± V across nodes NA and NB, a corresponding imbalance signal S will appear across nodes ND and NC. The bridge 152 is preferably connected so that like strain gages simultaneously undergoing tension or compression are at opposite positions in the bridge, as is indicated the labeling of each strain gage with either an uppercase T or C. This arrangement causes the imbalance signal S to be an additive representation of the strain in the flexure element 42.

Figure 9:
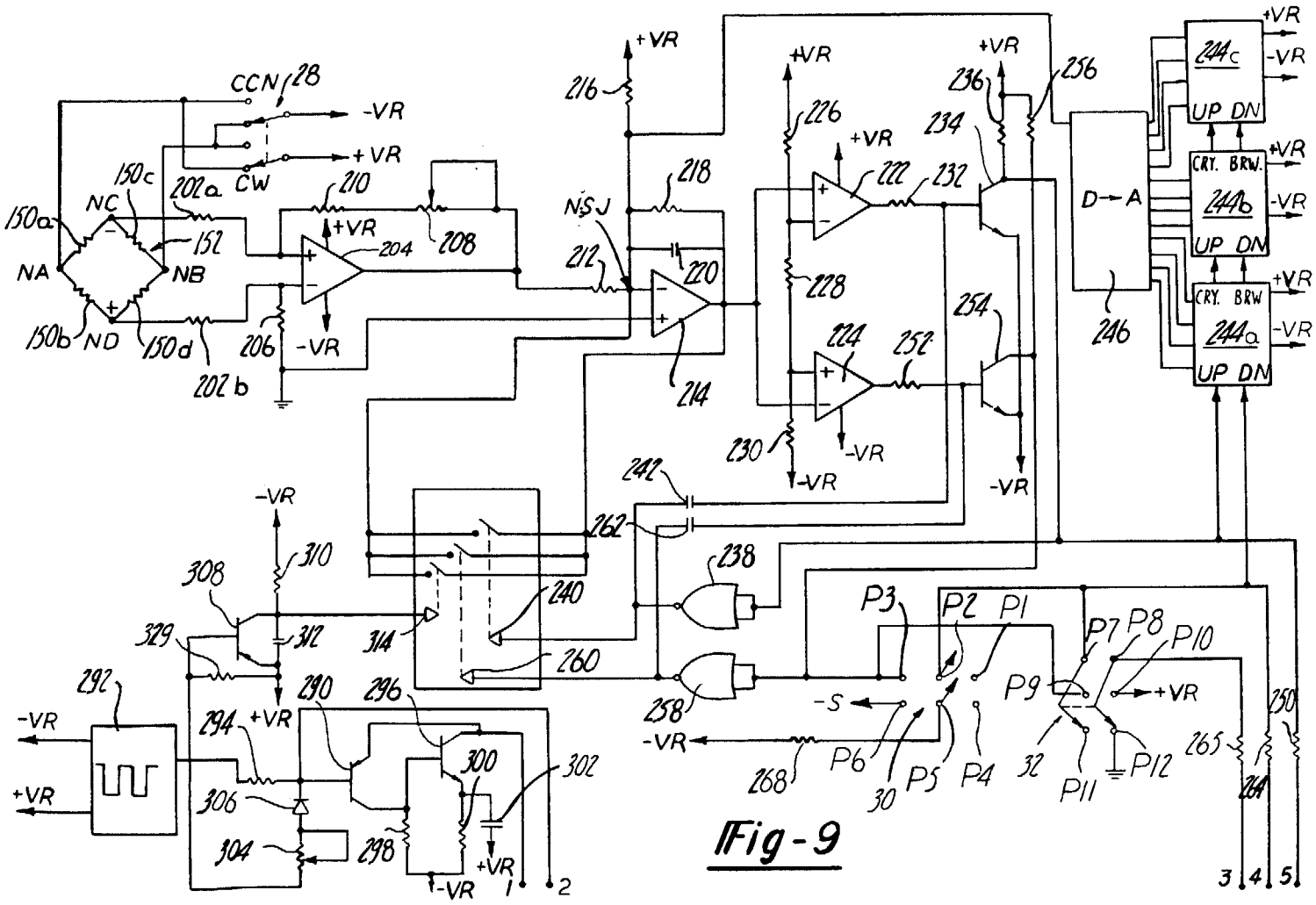
FIGS. 9 and 10 are schematic representations of the signal processing circuitry used in the detection and display of the torque applied by the wrench; and, FIG. 11 is a pictorial illustration of the arrangement of elements in one of a plurality of seven-element, light-emitting diode displays used to display a numerical representation of the applied torque.
Figure 10:
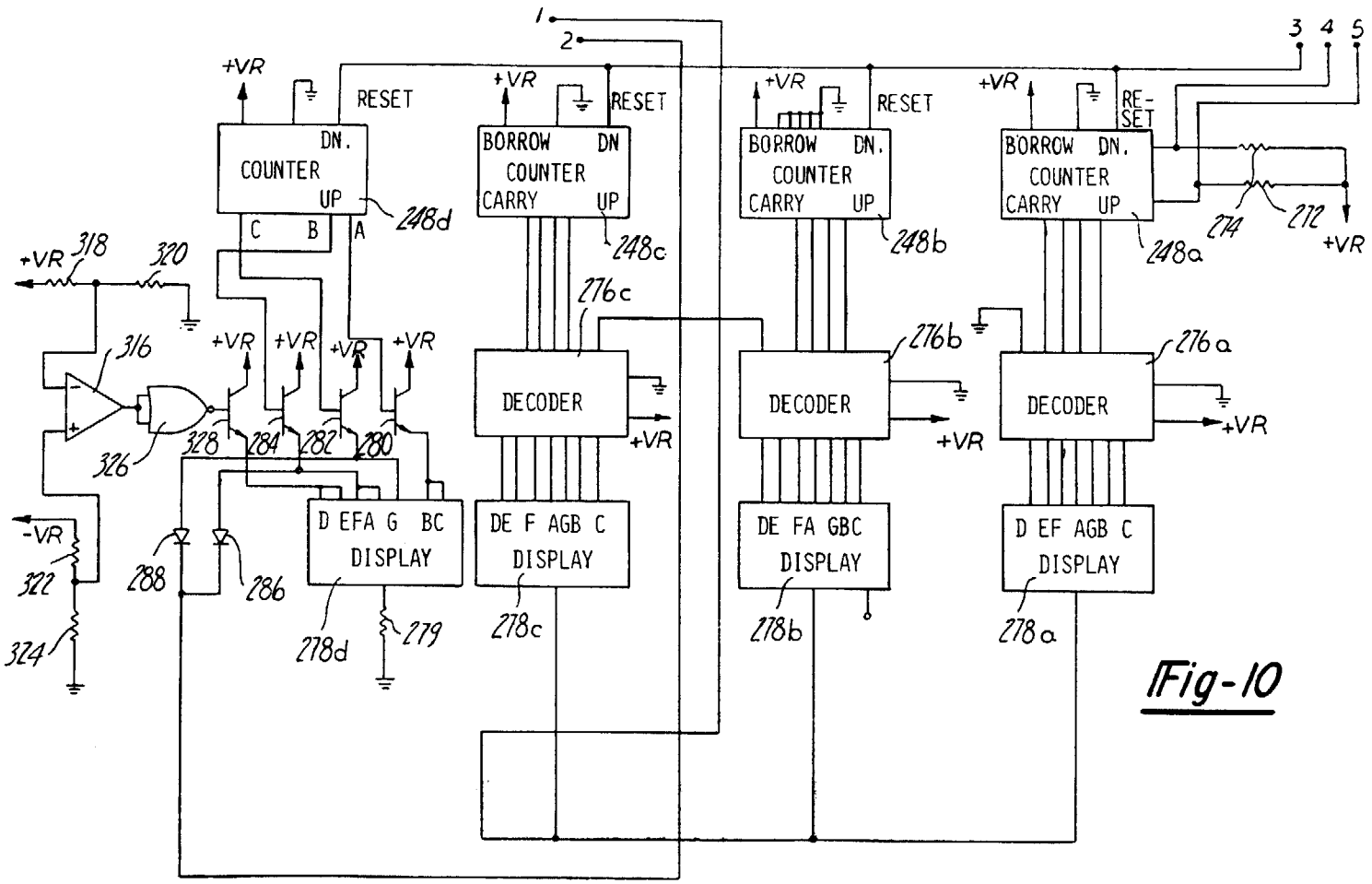

The circuitry for processing the bridge imbalance signal S of FIG. 8 into the display representation of the applied torque is shown in FIGS. 9 and 10.

The wrench 10 is first set for operation in either a clockwise or counterclockwise mode by positioning a single-throw-toggle switch 28 to energize opposing terminals Na and ND of the bridge 152 defined by the variable resistance strain gages 150*a, b, c,* and *d.* The bridge 152 is energized with a regulated dc voltage the polarity of which is dependent on the mode of operation, either clockwise or counterclockwise.

When torque is applied by the wrench, an imbalance signal S will appear across nodes ND and NC in the manner heretofore described. The magnitude of the imbalance signal S has a proportionate relationship to the variation in resistance of strain gage elements 150*a, b, c,* and *d* in accordance with well known bridge theory.

The imbalance signal S is fed across gain resistor 202*a* and *b* to the input of an amplifier 204. The negative input of amplifier 204 is tied to ground through a resistor 206. The amplified signal is fed back through a variable resistor 208 and a fixed resistor 210 to the positive input of the amplifier 204. The variable resistor 208 is used for full-scale adjustment in calibration. The fixed resistor 210 provides an effective feedback path to limit the open-loop gain of the amplifier 204.

The output of amplifier 204 is fed through a resistor 212 to the negative input of the comparator amplifier 214. The negative input is biased by the reference voltage +VR less the voltage drop across a resistor 216. The node shared by resistor 212 and the negative input to the comparator amplifier 214, designated as node NSJ, is effectively a summing junction for a following feedback circuit, as will be shown presently.

The positive input of the comparator amplifier 214 is kept at zero potential by tying it to ground. Thus, the output of the comparator amplifier 214 is high whenever there exists a non-zero potential or difference signal at node NSJ.

The output of the comparator amplifier is fed back through the parallel combination of a resistor 218 and a capacitor 220 to limit the open-loop gain of the comparator amplifier 214.

As indicated earlier, the signal progresses through a closed-loop, iterative feedback circuit whose purpose is to track the analog signal S from the bridge with an equivalent digital signal. The output signal from comparator amplifier 214 is in the nature of a difference signal flowing through the feedback circuit. Its magnitude is indicative of the absolute measure of difference between the digital equivalence signal and the analog signal S, and its polarity is indicative of whether the digital equivalence signal is high or low with respect to the analog signal S.

Accordingly, the output from comparator amplifier 214, i.e., the difference signal, is input to a parallel combination of comparators 222 and 224. The negative input of comparator 222 and the positive input of comparator 224 are biased at a very low voltage, on the order of 2% of the regulated voltage VR. This low voltage is in the nature of a tolerance voltage which defines the sensitivity of the circuit. The biasing is accomplished by using a voltage divider formed of the series combination of resistors 226, 228, and 230. The extreme ends of resistors 226 and 230 are held +VR and −VR respectively. By selecting resistor 228 to have its ohmic value of approximately 4% of the ohmic value of resistors 226 and 230, the proper biasing can be accomplished.

If the signal input to the parallel combination of comparators 222 and 224 is high, comparator 222 will be enabled. The output of comparator 222 is input through resistor 232 to the base of a transistor 234. The infusion of current into the base of transistor 234 causes it to change its state from cutoff to saturation. As transistor 234 begins to conduct, its collector voltage drops from a high level to a low level, owing to the fact that its emitter is held at the negative regulated voltage −VR. A resistor 236 limits the current through the transistor 234. The decrease in the collector voltage of transistor 234 is communicated to the input of an inverter 238, which is shown as a NOR gate with its two inputs tied together. The output of the inverter 238, which is normally low, switches to high, causing the voltage-controlled switch 240 to close. The closing of the switch 240 shorts out capacitor 220, driving the voltage at node NSJ, i.e., the difference signal, to a forced zero condition. This disables comparator 214 which, in turn, disables comparator 222, causing transistor 234 to switch states from saturation to cut-off and cause its collector voltage to step from low to high. The input to the inverter 238 likewise goes from low to high, causing the output of the inverter to reopen the voltage-controlled switch 240. A capacitor 242 is connected across the base of the transistor 234 to the output of the inverter 238 to square the leading edge of the inverter output signal.

The positive-going step in the collector voltage of transistor 234 triggers two sets of phenomenon described as follows.

First, the leading edge of the step is communicated to the "UP" input of a digital counter 244*a,* causing its count to increase by one unit. The digital counter 244*a* is connected in cascade with digital counters 244*b* and *c.* The count on each of counters 244*a, b* and *c* represents in binary form the quantity to be displayed. The outputs of the digital counters 244*a, b* and *c* are input to a digital-to-analog converter 246 which may be a conventionally resistive ladder network whose output is an analog voltage corresponding to the collective count on the digital counters 244*a, b* and *c.* This analog voltage is fed back to node NSJ to generate a new difference signal. This process is repeated until the difference signal at node NSJ is driven to zero.

The second phenomenon triggered by the leading edge of the step in the collector voltage of transistor 234 is a unit increase in the count of a bank of binary-coded decimal (BCD) counters 248*a, b, c* and *d.* The collector voltage is communicated through resistor 250 to the UP input of BCD counter 248*a,* increasing its current count by one unit. The operation of the BCD counters 248*a, b, c* and *d* will be hereinafter described more fully.

Referring again to the parallel combination of comparators 222 and 224, when the signal input to the comparators is low, comparator 224 will be enabled. This condition indicates that the current count on the digital counters 244*a, b* and *c* is high relative to the analog signal S from the bridge. This again initiates an iterative procedure which parallels the procedures occurring when comparator 222 is enabled.

The output of the comparator 224 is input to a resistor 252 to the base of a transistor 254, causing it to change its state from cut-off to saturation. As transistor 254 begins to conduct, its collector voltage drops from a high level to a low level, owing to the fact that its emitter is held at the negative regulated voltage −VR. A resistor 256 limits the current through the transistor 254. The decrease in collector voltage of transistor 254 is communicated to the input of an inverter 258 causing the inverter output to go from low to high. The positive-going transition in the output of inverter 258 causes a voltage-control switch 260 to close. The closing of switch 260 shorts out capacitor 220, driving the voltage at node NSJ to a forced zero condition. This disables amplifier 214, which, in turn, disables comparator 224, causing transistor 254 to switch from saturation to cut-off and cause its collector voltage to step from low to high. The input to inverter 258 likewise goes from low to high causing its output to reopen the voltage-control switch 260. A capacitor 262 is connected between the base of transistor 254 and the output of the inverter 258 to square the leading edge of the inverter output signal.

When the wrench is set for use in the normal tracking mode, the stepped increase in the collector voltage of the transistor 254 triggers two phenomena similar to those triggered by the stepped increase in the collector voltage of transistor 234. Specifically, the collector voltage change is communicated to the "DOWN" input of digital counter 244*a*, and through a resistor 264 to the "DOWN" input of "BCD" counter 248*a*, causing the current count on each bank of counters to decrease by one unit. Additionally, the outputs of digital counters 244*a, b* and *c* are input to the digital-to-analog converter 246 whose output is returned to node NSJ, the summing junction, as a feedback signal. The wrench can also function in peak or calibration modes in addition to a tracking mode. Mode selection is controlled through switch 30 which has three positions corresponding to the tracking, peak, and calibration mode. The switch 30 is accessible to the operator on the housing cover 22 as shown in FIG. 1.

In the tracking mode, pin P2 connects pin P3 and P4 connects pin P5. The effect of this connection is to provide uninterrupted signal paths from the collector of transistor 254 to the "DOWN" inputs of digital counter 244*a* and B, C, D, counter 248*a*.

In the peak signal detection mode, pin P1 connects P2 and pin P4 connects pin P5. The effect of this connection is to interrupt the signal paths from the collector of transistor 254 to the "DOWN" inputs of digital counter 244*a* and BCD counter 248*a* so as to prevent them from counting down.

In the calibration mode, pin P2 connects pin P3 and pin P5 connects P6. Pin 5 is connected through a large resistor 268 to the negative supply voltage and pin 6 is connected to receive the −S signal. This simulates an applied torque of precisely known magnitude and the reading in the display 34 can be calibrated by adjusting the variable resistor 208 through opening 31.

The wrench can be reset from the peak signal reading by pressing a reset button 32, accessible to the operator on the housing cover 22 of FIG. 1. When the reset button 32 is in its normal undepressed condition, pin P7 contacts pin P11 and pin P8 contacts pin P12. The effect of this connection is to avoid providing any continuous path to the RESET inputs of BCD counters 248*a, b, c* and *d*. When the reset button 32 is depressed, pin P7 contacts pin P9 and pin P8 contacts pin P10 which is energized at the positive regulated voltage +VR, causing a reset signal to be communicated through a resistor 265 to the RESET inputs of BCD counters 248*a, b, c* and *d*.

The balance of the circuitry is chiefly concerned with providing a numerical display of the digital count stored on BCD counters 248*a, b, c* and *d*.

In the embodiment illustrated, the first three counters in the cascade, 248*a, b* and *c* represent units, tens and hundreds, respectively. The fourth counter in the cascade 248*d*, is used for protective functions as will be hereinafter discussed more fully.

The UP and DOWN inputs of BCD counter 248*a* are positively biased through resistors 272 and 274, respectively, by the positive regulated voltage +VR.

The four outputs of each of the first three BCD counters 248*a, b* and *c* represent the binary-coded equivalent of the count on that counter. The combined outputs of BCD counters 248*a, b* and *c* represent a binary-coded decimal equivalent of their total count.

The outputs of each BCD counters 248*a, b* and *c* are fed to one of a set of corresponding decoder drivers 276*a, b* and *c*. The decoder driver functions as an interface for a corresponding set of seven-element light-emitting diode (LED) displays 278*a, b* and *c*. Each of the LED displays have seven light-emitting diodes arranged in the pattern illustrated in FIG. 11. By energizing the inputs A, B, C, D, E, F, or G of the LED display in a number of predetermined combinations, the full range of numerals 0–9 can be displayed; e.g., energizing inputs A, B and C will display the numeral 7.

The fourth BCD counter 248*d* is used to indicate overrange and underrange (negative) operation.

As presently illustrated, when the count exceeds 1999, an overrange condition exists. It is to be noted that the "thousands" digit does not have a full decimal range capability, it is limited to the "1" display. For displays of less than 1000, it is left unlighted. To light the "1" in the thousands position of the display, the signal for output A is applied to the base of transistor 280, causing it to switch from cut-off to saturation. As transistors 280 conducts, it energizes the B and C inputs of LED display 278*d* causing it to display the numeral "1" indicating that the count has entered the thousands. When the count exceeds 1999, the signal from output B of BCD counter 248*d* is input to the base of a transistor 284, causing it to switch from cut-off to saturation. As transistor 284 conducts, it energizes the F and A inputs to LED display 278*d*, causing it to display an overrange symbol.

When the count on the BCD counter 248*a, b, c* and *d* is negative, an underrange condition exists. This condition energizes the C output of BCD counter 248*d*. The signal from output C is input to the base of a transistor 282 causing it to switch from cut-off to saturation. As transistor 282 conducts, it energizes the G input of LED display 278*d* causing it to display a negative sign. LED display 278*d* is connected to ground through resistor 279.

The invention also includes a feature for blanking LED displays 278*a, b,* and *c* whenever an overrange or underrange condition exists. If overrange exists, transistor 284 is conducting, causing a diode 286 to be forward biased. If underrange exists, transistor 282 is conducting causing a diode 288 to be forward biased. The outputs of both diodes are joined in common to the base of a PNP transistor 290 which is in line with a common power line for LED displays 278*a, b,* and *c.* By reverse biasing the base of transistor 290, it causes the transistor to become non-conductive and cuts off power to LED displays 278*a, b,* and *c,* blanking them out.

The power source for the LED displays 278*a, b* and *c* is a squarewave generator 292 energized at the positive and negative regulated voltages, +VR and −VR, respectively. The squarewave output is effectively a strobe for the power to the LED displays 278*a, b,* and *c.* When the output from generator 292 is positive, which is preferably for about 7.2 milliseconds, the signal through resistor 294 reverse biases transistor 290, cutting it off. Therefore, for 7.2 milliseconds the LED displays 278*a, b,* and *c* are off to effect a savings in energy consumption. When the output from generator 292 is negative, which is preferably about 0.35 milliseconds, the signal through resistor 294 forward biases transistor 290, allowing it to conduct. Therefore, for 0.35 milliseconds the LED displays 278*a, b,* and *c* are off. This latter condition will be hereinafter discussed more fully.

The connection of PNP transistor 290 with NPN transistor 296 in the manner shown forms an oscillator. The emitter of transistor 290 is tied to the collector of transistor 296. The collector of transistor 290 and emitter of transistor 296 are energized by the negative regulated voltage, −VR, through resistor 298 and 300, respectively. The emitter of transistor 296 is connected to the negative terminal of an electrolytic capacitor 302; the positive terminal being held at the positive reference voltage, +VR. During the negative period of the squarewave output generator 292, the oscillatory output alternatively energizes and non-energizes LED displays 278*a, b,* and *c* to effect a further savings in energy consumption. The display circuit also incorporates leading zero blanking to conserve power. This is accomplished by interconnecting decoders 276*a,* 276*b* and 276*c* such that an overflow from a lower significant digit counter is required to actuate the next higher significant digit counter.

The brightness of LED displays 278*a, b,* and *c* can be adjusted with a variable resistor 304 which is energized by the positive regulated voltage +VR through resistor 329 and whose output is communicated to the base of transistor 290 through a forward bias diode 306.

The squarewave output of generator 292 is also used to enable and disable the closed loop digital conversion circuit earlier discussed. The base of PNP transistor 308 is positively biased by the output of variable resistor 304, causing it to be normally in cut-off. When a negative signal from generator 292 is input to the base of transistor 308 it begins to conduct. The collector of transistor 308 is energized by the negative regulated voltage −VR, through resistor 310; the emitter is energized by the positive regulated voltage, +VR. A capacitor 312 is connected across the collector and emitter of transistor 308 to provide a delay in the output. When the capacitor 312 charges, it causes a voltage-controlled switch 314 to close, driving to a forced zero condition the voltage at node NSJ, thereby shutting down the digital conversion circuit, while the LED displays 278*a, b,* and *c* are on, to effect a noise-free digital conversion circuit.

The wrench 10 has a feature protecting against low battery operation. As shown in FIG. 10, a comparator 316 has a positive and a negative input. The negative input is taken off a voltage divider, formed of two resistors of comparable ohmic value, 318 and 320, energized by the positive reference voltage, +VR. The positive input is taken off a second voltage divider, formed of resistors 322 and 324, where resistor 322 has approximately twice the ohmic value of resistor 324, energized by the plus battery voltage. Whenever the positive signal to comparator 316 falls below the negative signal, the comparator is disabled. A low output of comparator 316 causes the output of an inverter 326 to go high, causing a transistor 328 to conduct. The signal from transistor 328 is communicated to the D and E inputs LED display 278*d,* causing an appropriate symbol to be displayed.

The following is a listing of commercially availalbe components that are suitable for use in a practical embodiment of the present invention. Their inclusion here is intended to be illustrative, and not limiting.

| REFERENCE NUMERAL OF COMPONENT | NATIONAL SEMICONDUCTOR PRODUCT NO. |
|---|---|
| 204 | LH0044CH |
| 214 | LM324 |
| 222 | " |
| 224 | " |
| 316 | " |
| 248a | MM74C193 |
| 248b | " |
| 248c | " |
| 240 | MM5616 |
| 260 | " |
| 314 | " |
| 238 | 4001AE |
| 258 | " |
| 326 | " |
| 248a | MM74C192 |
| 248b | " |
| 248c | " |
| 248d | " |
| 276a | MM74C48 |
| 276b | " |
| 276c | " |
| 278a | NSN74R |
| 278b | |
| 278c | |
| 278d | |
| 292 | LM555CN |
| 290 | 2N2907A |
| 296 | 2N3053 |
| 308 | 2N2907A |
| 234 | 2N2222 |
| 254 | " |
| 280 | " |
| 282 | " |
| 284 | " |
| 328 | " |
| 306 | MV5023 |
| 286 | 1N3064 |
| 288 | " |
| | ALLEN BRADLEY PRODUCT NO. |
| 246 | FN114 |

The circuit components are preferably mounted on and innerconnected by printed circuit boards of the type schematically illustrated in FIG. 4. However, alternative embodiments, including fabrication of integrated circuit chips incorporating large blocks of the circuitry, are also possible.

Additional variations in the embodiments shown herein are possible and will suggest themselves to those having skill in the art without departing from the scope of the present invention. Several features of the invention are, however, of substantial importance. These include placing the flexure element in the turning head of the wrench rather than on the wrench body as suggested by the Otto patent previously identified. This eliminates the unacceptable sensitivity to variation in point of force application which characterizes devices like Otto. Another feature is the iterative circuitry. Another is the mechanical construction of the wrench body. Obviously, these features may be used in combination or individually.

The embodiments of the invention in which an exclusive property or privilege is claimed are defined as follows:

1. In an electronic torque wrench of the class having an elongated body for operating as a torquing lever and terminating at one end in a receptacle adapted to rotate coaxially with a workpiece about an axis of rotation, a solid flexure element of high modulus of elasticity material, non-rotatably, removably insertable into the receptacle and having a drive for engaging the workpiece, visual read-out means mounted on the body, circuit means carried by the body for receiving strain signals, for converting said strain signals into torque signals and for actuating said read-out means with said torque signals, strain responsive means mounted on the flexure element for producing a strain signal related to the torque transmitted by the flexure element, and means connecting the strain responsive means to the circuit means through at least a portion of said body.

2. The electronic torque wrench as defined in claim 1, wherein lateral sides of the flexure element are defined by first and second planar surfaces diametrically opposed about the axis of rotation, said strain responsive means being mounted on said planar surfaces.

3. The electronic torque wrench as defined in claim 2, wherein the strain responsive means comprises a bridge circuit formed of resistive strain gages affixed to the first and second planar surfaces.

4. An electronic torque wrench comprising: an elongated body having a drive end for engaging means to turn a workpiece;

means carried by the body for generating an analog signal quantity related to the torque applied to the workpiece by said body;

comparator means having two inputs and an output, the signal on said output being the difference between the signals on said inputs, means connecting the analog signal to one of said inputs, digital counter means for storing a count signal;

converter means responsive to the count signal on the digital counter means for converting the count signal to an analog feedback signal;

means for connecting the analog feedback signal to said one input of the comparator means, switch means responsive to a non-zero difference signal to transitorily disable the comparator means; means for connecting the output of the comparator means to said one input thereof through the switch means;

said switch means being connected to the counter means to increment the count signal in the digital counter means for each operation thereof, the sense of said increment being selected in accordance with the polarity of the difference signal; and display means for displaying a numerical representation of the count signal in the digital counter means.

5. The electronic torque wrench as defined in claim 4, wherein the means carried by the body for generating an analog signal quantity comprise strain transducer means sensitive to the elastic deformation in the elongated body associated with the applied torque to generate a corresponding electrical analog signal.

6. The electronic torque wrench as defined in claim 4, wherein the digital counter means comprises first and second banks of binary counters; the first bank of binary counters being operatively coupled to the converter means, and the second bank of binary counters being operatively coupled to the display means.

7. The electronic torque wrench as defined in claim 4, wherein the display means includes a plurality of light emitting diode displays.

8. The electronic torque wrench as defined in claim 4, further comprising, power strobing means for alternatively energizing the comparator means and the display means.

9. The electronic torque wrench as defined in claim 4, further comprising, means for detecting an overrange operating condition and displaying a symbol signifying the same.

10. The electronic torque wrench as defined in claim 4, further comprising, means for detecting an underrange operating condition and displaying a symbol signifying the same.

11. The electronic torque wrench as defined in claim 4, further comprising mode selection means for selectively displaying only the peak value of the count signal.

12. The electronic torque wrench as defined in claim 4, further comprising, reset means operatively coupled to the display means for initializing the count signal.

13. An electronic torque wrench comprising:

a rigid body for use as a torque lever, a receptacle adjacent one end of the body and having a drive axis which is substantially perpendicular to the longitudinal axis of the body, said receptacle having a plurality of contiguous flat reaction surfaces formed therein about said drive axis, a drive element of high modulus of elasticity material having first and second longitudinally opposite ends, one of said ends having a plurality of reaction surfaces formed thereon about the longitudinal axis and in correspondence with the reaction surfaces of said receptacle and being dimensioned to non-rotatably fit within said receptacle with said reaction surfaces in substantially mating engagement such that torque may be transmitted from said lever to said element, the other end of said element having a drive configuration formed thereon suitable for mating with a fastener device for the transmission of torque from said lever to said fastener device through said element, said element further carrying strain gage resistors interconnected in an electrical circuit for producing an analog signal quantity in response to torque produced strain in said element, and digital display means carried by said body and connected to receive and be actuated by the signal from said strain gage resistor circuit to display a number representing torque transmitted through said element.

14. A torque wrench as defined in claim 13 wherein said body is hollow along the longitudinal axis thereof to receive batteries for the enegization of said electrical circuit and said digital display means.

15. A torque wrench as defined in claim 13 further comprising a driveshaft having a first end adjoining the receptacle and a second end connected to said body, and means for releasably securing the driveshaft in any of a plurality of angular orientations about the longitudinal axis of said body.

* * * * *